US010974249B2

(12) United States Patent
Kinzel et al.

(10) Patent No.: US 10,974,249 B2
(45) Date of Patent: Apr. 13, 2021

(54) ROTOR, GRINDING MACHINE, AIR EXTRACTION CASING, AND GRINDING ELEMENT FOR A GRINDING MACHINE

(71) Applicant: BÜHLER AG, Uzwil (CH)

(72) Inventors: Benjamin Kinzel, Müllheim (CH); Jürgen Moosmann, Berg (DE)

(73) Assignee: BÜHLER AG, Uzwil (CH)

( * ) Notice: Subject to any disclaimer, the term of this patent is extended or adjusted under 35 U.S.C. 154(b) by 311 days.

(21) Appl. No.: 15/779,145

(22) PCT Filed: Dec. 2, 2016

(86) PCT No.: PCT/EP2016/079638
§ 371 (c)(1),
(2) Date: May 25, 2018

(87) PCT Pub. No.: WO2017/093513
PCT Pub. Date: Jun. 8, 2017

(65) Prior Publication Data

US 2019/0070612 A1 Mar. 7, 2019

(30) Foreign Application Priority Data

Dec. 4, 2015 (EP) ..... 15198064

(51) Int. Cl.
*B02B 3/04* (2006.01)
*B02B 3/00* (2006.01)
(Continued)

(52) U.S. Cl.
CPC ..... *B02B 3/04* (2013.01); *B02B 3/00* (2013.01); *B02B 5/02* (2013.01); *B02B 7/02* (2013.01); *B02B 1/00* (2013.01)

(58) Field of Classification Search
CPC .... B02B 3/04; B02B 3/00; B02B 5/02; B02B 7/02; B02B 1/00; B02C 7/02; B02C 7/08; B02C 7/12
See application file for complete search history.

(56) References Cited

U.S. PATENT DOCUMENTS 5,394,792 A 3/1995 Satake et al.
5,511,469 A * 4/1996 Satake ..... B02B 3/04 99/519
(Continued)

FOREIGN PATENT DOCUMENTS

CH 265510 A 12/1949
CN 2633418 Y 8/2004
(Continued)

OTHER PUBLICATIONS

Chinese Office Action issued in corresponding Chinese Patent Application No. 201680080096.4 dated Jul. 25, 2019.
(Continued)

*Primary Examiner* — Ryan J. Walters
(74) *Attorney, Agent, or Firm* — Davis & Bujold PLLC; Michael J. Bujold

(57) ABSTRACT

A rotor (1) for a grinding machine (2) for the foodstuffs and feedstock industry, having an external diameter of between 0.5 and 0.6 m, comprising a plurality of substantially cylindrical, in particular hollow cylindrical, grinding elements (3). One such grinding element (3) has an outer grinding surface (4) substantially in the form of a circular cylinder jacket, and the grinding elements (3) are arranged coaxially above one another and in such a way that a substantially annular air gap (5) is produced between the grinding surfaces (4) of two adjacent grinding elements (3). A ratio
(Continued)

between an enveloping surface (H) of the rotor (1) and a total grinding surface of the rotor (1) is greater than 1.05 and less than 1.25.

17 Claims, 8 Drawing Sheets

(51) Int. Cl.

| | |
|---|---|
| ***B02B 5/02*** | (2006.01) |
| ***B02B 7/02*** | (2006.01) |
| *B02B 1/00* | (2006.01) |

(56) References Cited

U.S. PATENT DOCUMENTS

| | | | |
|---|---|---|---|
| 5,752,664 | A | 5/1998 | Satake et al. |
| 2012/0067990 | A1 | 3/2012 | Seto et al. |

FOREIGN PATENT DOCUMENTS

| | | | |
|---|---|---|---|
| DE | 694 17 666 | T2 | 7/1999 |
| DE | 10 2005 027 343 | A1 | 12/2006 |
| EP | 0 668 107 | A1 | 8/1995 |
| GB | 2 101 467 | A | 1/1983 |
| JP | 2001-113188 | A | 4/2001 |
| JP | 3624409 | B2 | 3/2005 |
| NL | 70809 | C | 9/1952 |

OTHER PUBLICATIONS

European Search Report Corresponding to 15198064.6 dated Jun. 15, 2016.
European Search Report Corresponding to 15198064.6 dated Sep. 14, 2016.
International Search Report Corresponding to PCT/EP2016/079638 dated Mar. 23, 2017.
Written Opinion Corresponding to PCT/EP2016/079638 dated Mar. 23, 2017.
Indian Office Action issued in corresponding Indian Patent Application No. 201817023955 dated Dec. 24, 2019.

* cited by examiner

ROTOR, GRINDING MACHINE, AIR EXTRACTION CASING, AND GRINDING ELEMENT FOR A GRINDING MACHINE

The invention relates to a rotor and a grinding machine for the foodstuffs and feedstock industry, to a grinding element for a grinding machine, and an air extraction casing according to the preamble of the independent claims.

Grinding machines are used in the foodstuffs and feedstock industry in order to selectively grind down, layer by layer, the outer layers of grain products, pulses and the like, such as rice, (hard) wheat, bulgur, rye, barley, millet, peas, lentils, quinoa, durum, dry beans and pepper, for example so as to make subsequent processing easier and so as to influence the organoleptic properties. For this, rotating grinding discs are used, which are coated with an abrasive material and/or are provided with an abrasive surface. Due to the design, as the product that is to be ground passes through the grinding machine it is brought into contact with the abrasive material or the abrasive surface and is ground down. Known grinding machines, however, are not satisfactory in many ways with regard to the provided grinding performance, also referred to as the grinding grade.

An increased throughput with low energy consumption is generally desired. This can be achieved with grinding machines from the prior art only with an arrangement of a plurality of grinding machines in parallel or in series. For example, with a grinding machine from the applicant (Bühler A G, Uzwil), with a motor output of 55 kW and a throughput of 8 t/h, a grinding grade in the case of hard wheats of at most just 2% is currently achievable.

By increasing the rotational speed of the grinding discs, higher grinding grades or throughputs would be possible, but the abrasive surface or the abrasive material would be destroyed. In addition, the abraded grinding dust would quickly clog the abrasive surface or the abrasive material and reduce the grinding performance.

Further challenges are constituted by the metering of the product that is to be ground into the grinding machine and the control (closed-loop and/or open-loop) of the outlet of the grinding machine, which until now have been unsatisfactory.

The object of the invention is therefore to describe a rotor for a grinding machine which avoids the disadvantages of the known grinding machines and in particular allows a high throughput with sufficient grinding performance and which is not clogged by abraded grinding dust. In addition, the rotor should be able to withstand high rotational speeds and peripheral speeds.

The object is achieved with a rotor according to the characterising part of the independent claim.

The rotor comprises a plurality of substantially cylindrical grinding elements each having an outer grinding surface substantially in the form of a circular cylinder jacket.

Due to manufacturing reasons, it is not possible to produce a grinding surface with a 90° edge, and therefore grinding surfaces are usually rounded or chamfered. In the sense of the present invention, the expression "grinding surface substantially in the form of a circular cylinder jacket" will therefore be understood to mean a grinding surface which approximates a circular cylinder jacket surface and can have a rounded or chamfered edge.

The grinding element is preferably formed as a hollow cylinder. This is preferred in particular for weight and cost reasons. In addition, an airflow can be generated within the rotor, which airflow assists the removal of the abraded grinding dust and thus counteracts a clogging of the grinding surfaces.

The grinding elements are arranged coaxially above one another and in such a way that a substantially annular air gap is produced between the grinding surfaces of two adjacent grinding elements. It is clear to a person skilled in the art that the grinding elements have substantially the same outer diameter. Furthermore, due to the form of the grinding surface with a rounded or chamfered edge, the air gap is likewise approximately annular.

In accordance with the invention a ratio between an enveloping surface of the rotor and a total grinding surface of the rotor is greater than 1.05, preferably greater than or equal to 1.1, even more preferably greater than or equal to 1.12.

The ratio between the enveloping surface of the rotor and the total grinding surface of the rotor is less than 1.25.

The enveloping surface of the rotor, on account of the form of the grinding surface with a rounded or chamfered edge, is defined by the enveloping surface of a circular cylinder with rotor diameter. The height of the rotor is measured between the outer edges of the grinding elements.

Accordingly, the total grinding surface is defined as the sum of the grinding surfaces of the grinding elements, wherein each grinding surface is defined by the enveloping surface of a circular cylinder with rotor diameter (equal to grinding element diameter) and grinding element height. The grinding element height does not include any spacers, fastening elements or the like, which might protrude beyond the grinding element height.

It has surprisingly been found that a ratio according to the invention allows very high rotational speeds of the rotor, such that a higher throughput than before is possible accordingly. In addition, the air gaps allow the removal of abraded grinding dust, such that the grinding surface does not become clogged, in particular when the grinding elements are hollow.

The rotor preferably has a total grinding surface between 0.7 and 1.2 $m^2$ and/or an enveloping surface between 0.8 and 1.5 $m^2$.

The rotor has an outer diameter between 0.5 and 0.6 m.

Here, it is possible, in particular in the case of a hollow rotor, that sufficient air can be conveyed through the air gaps in order to remove the abraded grinding dust. In addition, it is possible, with an outer diameter of this kind, to achieve optimal peripheral speeds at relatively low rotational speeds of the rotor.

Here, the rotor preferably has a height between 0.5 and 0.6 m.

This makes it possible to provide sufficient grinding surface to satisfy the stated requirements of throughput and grinding grade.

A ratio between grinding element height and outer diameter is preferably between 1/8 and 1/12.

The height of the annular air gap is preferably between 5 and 9 mm.

The grinding elements are preferably identical and equally distanced from one another, such that the most optimal and homogeneous possible flow of air through the rotor and an associated removal of abraded grinding dust is produced.

A grinding element preferably comprises a main body having an outer surface substantially in the form of a circular cylinder jacket and a coating applied to the outer surface.

The manufacture of the grinding elements is thus simplified. In addition, it is possible to remove worn grinding surfaces or coatings and to freshly coat the main bodies.

The coating is preferably a diamond coating. It can contain natural or synthetic diamond. The coating comprises diamond as abradant and can comprise further auxiliary materials as carrier and/or abradant. Further materials, such as quartz, corundum, emery, garnet, silicon carbide, chromium oxide and boron nitride are possible alternatively or additionally.

The diamond coating is preferably a galvanic diamond coating. Here, the main body preferably comprises at least one metallic outer surface.

A galvanic diamond coating allows a very stable grinding surface to be formed, which withstands very high rotational speeds and peripheral speeds.

The coating, in particular the diamond coating, preferably has a mean particle size between 0.3 mm and 0.8 mm.

A mean particle size of this kind has proven to be particularly suitable for the treatment of foodstuffs and feedstock.

A further object of the invention is to provide a grinding machine for the foodstuffs and feedstock industry which avoids the disadvantages of the known grinding machines and in particular has a high throughput with sufficient grinding performance and in which the rotor is not clogged by abraded grinding dust.

This object is achieved by a grinding machine according to the characterising part of the independent claim.

The grinding machine comprises a substantially cylindrical rotor, a rotor housing with an inlet and an outlet for the product that is to be ground and for the product that has been ground, respectively, and a drive for driving the rotor. The rotor is a rotor according to the invention.

In accordance with the invention, the rotor is directly driven. In particular, a drive shaft of the drive is directly connected to the rotor. What is meant here is that the drive shaft is not driven by means of transmission elements, such as chains, belts, bands and the like, or also gearing units, as was previously conventional. An arrangement of this kind allows a particularly hygienic design of the grinding machine, since machine elements which are abraded and/or lubricated can be formed separately from the product. Here, the drive shaft is preferably arranged coaxially with the rotor.

The grinding machine and/or the rotor housing preferably have/has a grinding chamber with a chamber wall that is substantially in the form of a circular cylinder jacket and that coaxially surrounds the rotor. The chamber wall is arranged at a distance from the grinding surface, such that a grinding gap is formed. During operation the product that is to be ground is conveyed into the grinding gap and ground there. Here, the axis of rotation of the rotor is preferably arranged perpendicularly to a gravity vector, such that the product to be ground can be conveyed only by the force of gravity. Of course, other arrangements of the rotor however are also possible depending on the application.

The grinding gap width, i.e. the distance as measured radially between the chamber wall and grinding surface, is preferably between 15 and 25 mm.

The chamber wall is preferably provided with a plurality of air passage openings. The air passage openings enable air to flow out from and into the rotor housing, so that the lightweight, abraded grinding dust can be removed thereby. The air passage openings are preferably formed as slots. Compared to circular holes, slots have a lower tendency towards clogging.

The slots are preferably between 0.8 mm and 1.5 mm wide. In this sense, the width of the slots is measured as the distance between two side walls of the slots in a direction perpendicular to the longitudinal extent of the slots.

The chamber wall is preferably provided with protruding braking strips and backup strips, which extend substantially parallel with or in a manner running coaxially around the rotor axis. The braking strips and backup strips cause a reduction of the grinding gap width in the region of the braking strip and backup strip and cause a deflection of the product that is to be ground, such that it can be ensured that the product that is to be ground is processed uniformly.

The braking strips are adjustable here, such that the protrusion relative to the chamber wall can be adjusted between 4 mm and 10 mm.

The outlet preferably has at least one gate valve for adjusting a product flow. The gate valve is preferably arranged in such a way that a direction of closing or opening of a valve plate of the gate valve is substantially perpendicular to the gravity vector. The movement of the valve plate therefore is not hindered by the weight of the abraded product, which is backed up depending on the position of the valve plate and loads the valve plate. In addition, a gate valve can be adjusted better and more precisely than, for example, shut-off cones with a counterweight. The gate valve is preferably formed as an annular orifice with a plurality of outlet openings.

The gate valve and/or the annular orifice is preferably controlled (by closed-loop and/or open-loop control), that is to say (partially) opened and closed, depending on the power consumption of the drive. Since the grinding performance and consequently the grinding grade is related to the power consumption of the drive, the desired grinding grade can be adjusted in a simple manner by means of a characteristic curve of the grinding machine by backing up the product that is to be ground in the grinding gap and controlling (by closed-loop and/or open-loop control) the gate valve and/or the annular orifice in such a way that the power consumption of the drive remains constant.

The rotor is operable at a rotational speed between 1400 and 1800 revolutions/min and/or a peripheral speed between 40 and 100 m/s.

The grinding machine preferably comprises an air extraction device, which preferably is operable with an extraction power between 40 and 95 $m^3$/min.

A plurality of air extraction channels is preferably arranged around the chamber wall and fluidically connected to the air extraction device.

The air extraction channels preferably form an encasement of the chamber wall and are arranged above one another. During operation, an airflow is preferably generated by means of the air extraction device over the air extraction channels, such that air flows from outside, over the rotor and through the air gaps between adjacent grinding elements of the rotor and the air passage openings of the chamber wall and entrains the lightweight, abraded grinding dust.

The air extraction channels are preferably formed as an encasement of the grinding chamber with a lateral surface and a plurality of radial bases, which extend between the lateral surface and chamber wall. The lateral surface is preferably not arranged concentrically with the rotor and chamber wall, and instead extends such that, as considered in the circumferential direction of the rotor or the chamber, a distance from the chamber or rotor increases, in particular continuously. The lateral surface preferably extends in a spiralled manner.

The air extraction channels enable a homogeneous distribution of the airflow over the entire height of the rotor and the chamber wall, such that a clogging of the grinding surface and a blocking of the air passage openings is counteracted to the greatest possible extent. Furthermore, the preferred extent of the lateral surface makes it possible to provide a constant pressure drop over the entire circumference of the rotor or chamber wall.

The rotor is preferably mounted on one side. In particular, the rotor is mounted in a lower region, wherein the upper end face of the rotor is provided with a cover that is conical or in the form of a frustum of a cone. The inlet for the product to be ground is also arranged in this region. The inlet is preferably arranged centrally, that is to say concentrically with the rotor. This allows a uniform distribution of the product that is to be ground over the entire circumference of the rotor in the grinding gap. In addition, there is no longer any need for conveying devices in the inlet region, which is desirable in respect of a hygienic design.

The invention also relates to a method for operating a grinding machine for the foodstuffs and feedstock industry. Here, the comments above relating to the grinding machine according to the invention can be applied accordingly.

The invention also relates to a grinding element for a grinding machine according to the invention for the foodstuffs and feedstock industry.

The grinding element is substantially cylindrical, in particular hollow cylindrical, and has an outer grinding surface substantially in the form of a circular cylinder jacket.

In accordance with the invention a ratio between the height of the grinding surface and outer diameter of the grinding element is between 1/8 and 1/12.

Advantages and possible developments of a grinding element of this kind are evident from the above description and apply similarly for the grinding element according to the invention. The retrofitting of existing rotors is thus made possible.

The invention also relates to an air extraction casing for a grinding machine for the foodstuffs and feedstock industry.

The air extraction casing is suitable in particular for the retrofitting of existing grinding machines.

The air extraction casing comprises a lateral surface which can be arranged around a rotor or a chamber wall of a grinding chamber of a grinding machine provided with air passage openings and which can be fluidically connected to an air extraction device.

The lateral surface is formed here in such a way that it is not arranged concentrically with the rotor or the chamber wall, and instead a radial distance between the lateral surface and the chamber and/or the rotor axis (and thus the grinding surface), as considered in the circumferential direction of the rotor or the chamber, increases, preferably continuously. The lateral surface more preferably extends in a spiralled manner.

The air extraction casing preferably forms a plurality of air extraction channels that can be arranged around the rotor or the chamber wall.

The air extraction channels are preferably arranged above one another. During operation an airflow is preferably generated by means of the air extraction device over the air extraction channels, such that a negative pressure is created in the grinding chamber and the lightweight, abraded grinding dust can be removed from the grinding chamber.

The air extraction casing preferably comprises a lateral surface and a plurality of radial bases, which extend between the lateral surface and chamber wall of a grinding chamber.

The air extraction casing enables a homogeneous distribution of the airflow over the entire height of the rotor and the chamber wall, such that a clogging of grinding surfaces and a blocking of the air passage openings is counteracted to the greatest possible extent. Furthermore, the preferred extent of the lateral surface makes it possible to provide a constant pressure drop over the entire circumference of the rotor or the chamber wall.

The invention will be better described hereinafter on the basis of a preferred exemplary embodiment in conjunction with the drawing, in which.

Figure 1:
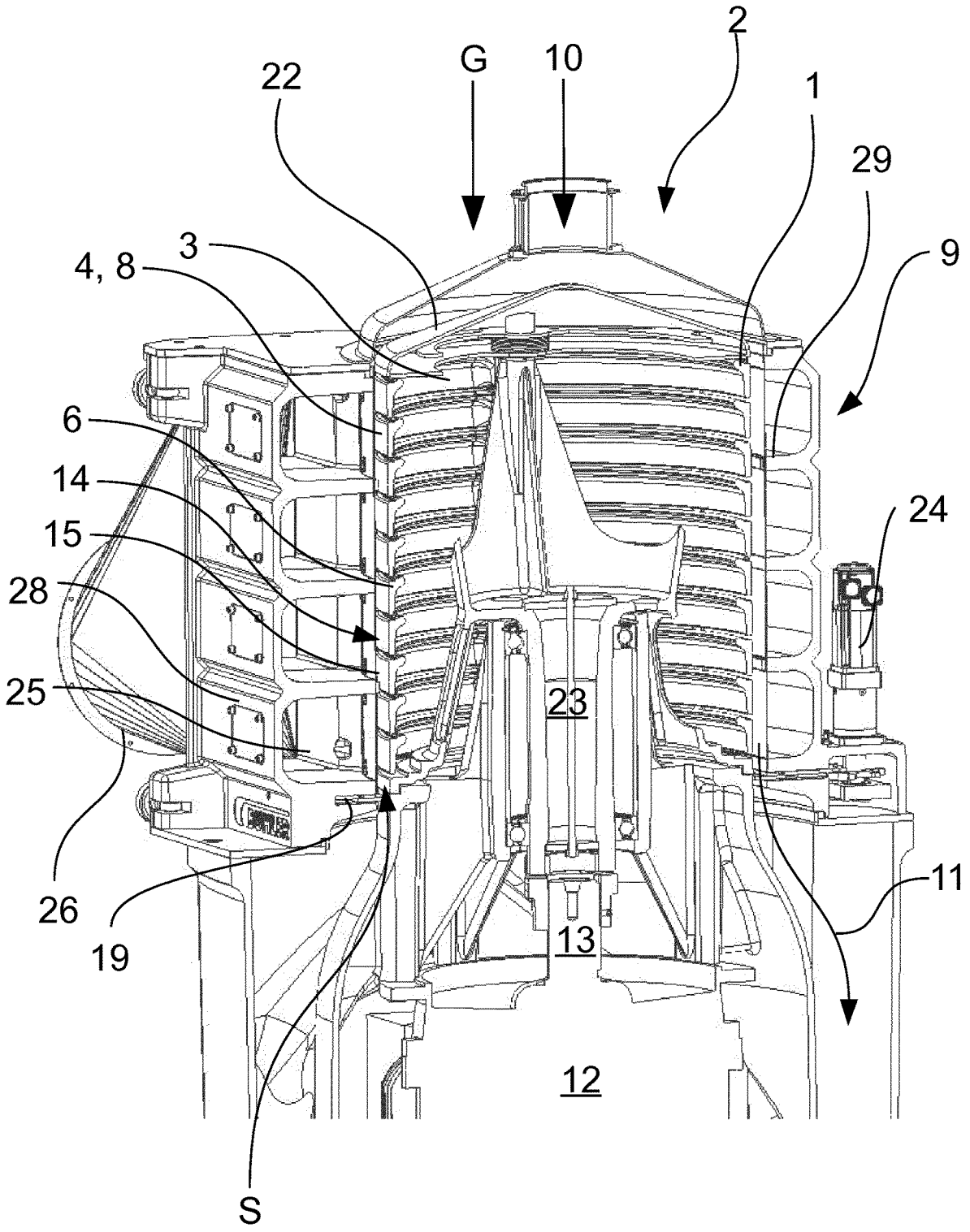
FIG. 1 shows a perspective sectional view of a preferred embodiment of a grinding machine.

FIGS. 1 to 7 show a grinding machine 2 which is equipped with a rotor 1. The rotor 1 is arranged in a grinding chamber 14 of a rotor housing 9 of the grinding machine 2, wherein a rotor axis R is arranged parallel to a gravity vector G.

The rotor 1 is composed of ten grinding elements 3, which are stacked in such a way that an air gap 5 is formed between two adjacent grinding elements 3.

Each grinding element 3 consists of a metallic hollow cylindrical main body 6 having an outer surface 7. A galvanic diamond coating 8 has been applied to the outer surface 7.

The coatings 8 as a whole form the grinding surface 4 of the rotor.

Figure 2:
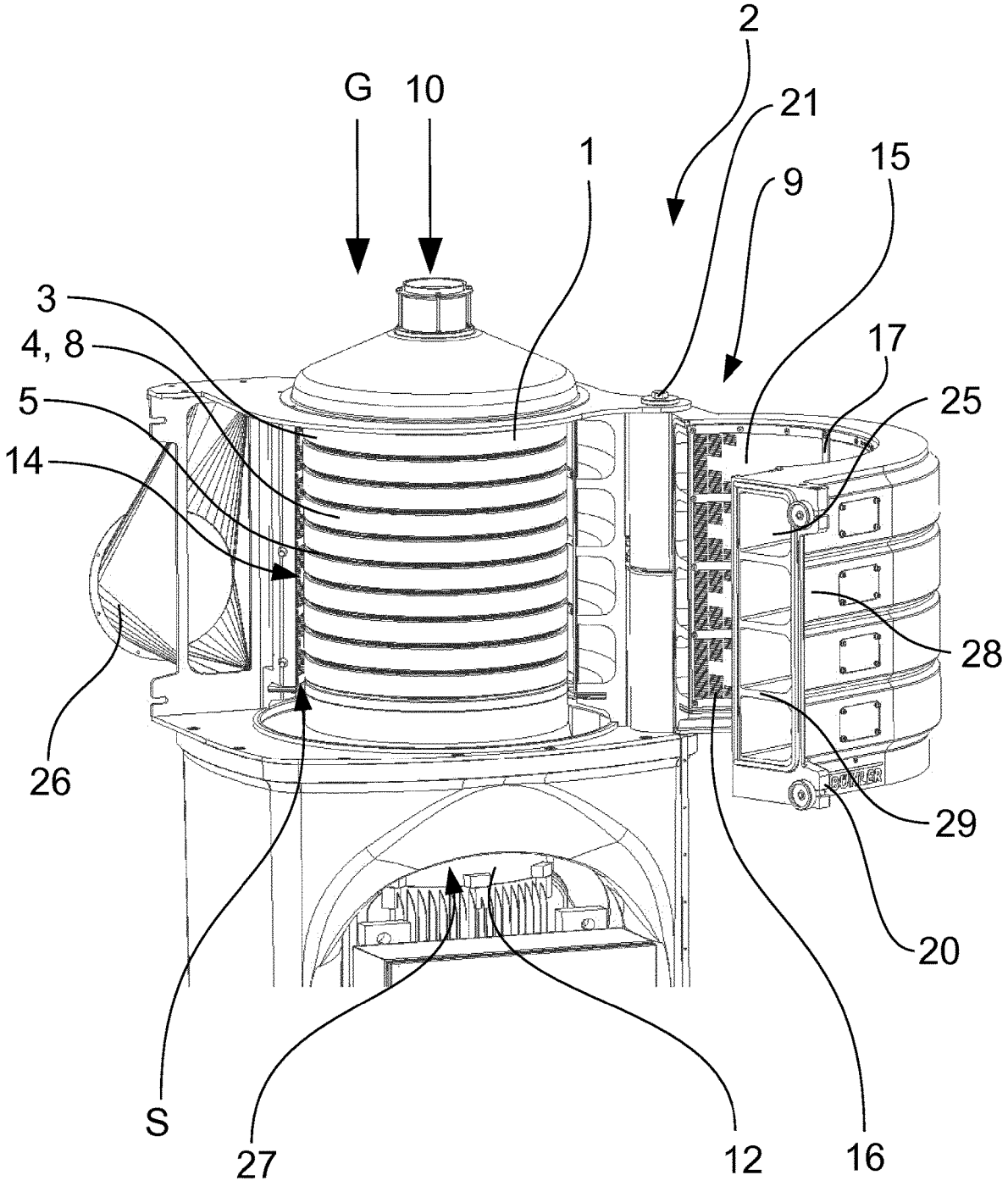
FIG. 2 shows a perspective view of the grinding machine of FIG. 1 with opened chamber wall.
Figure 3:
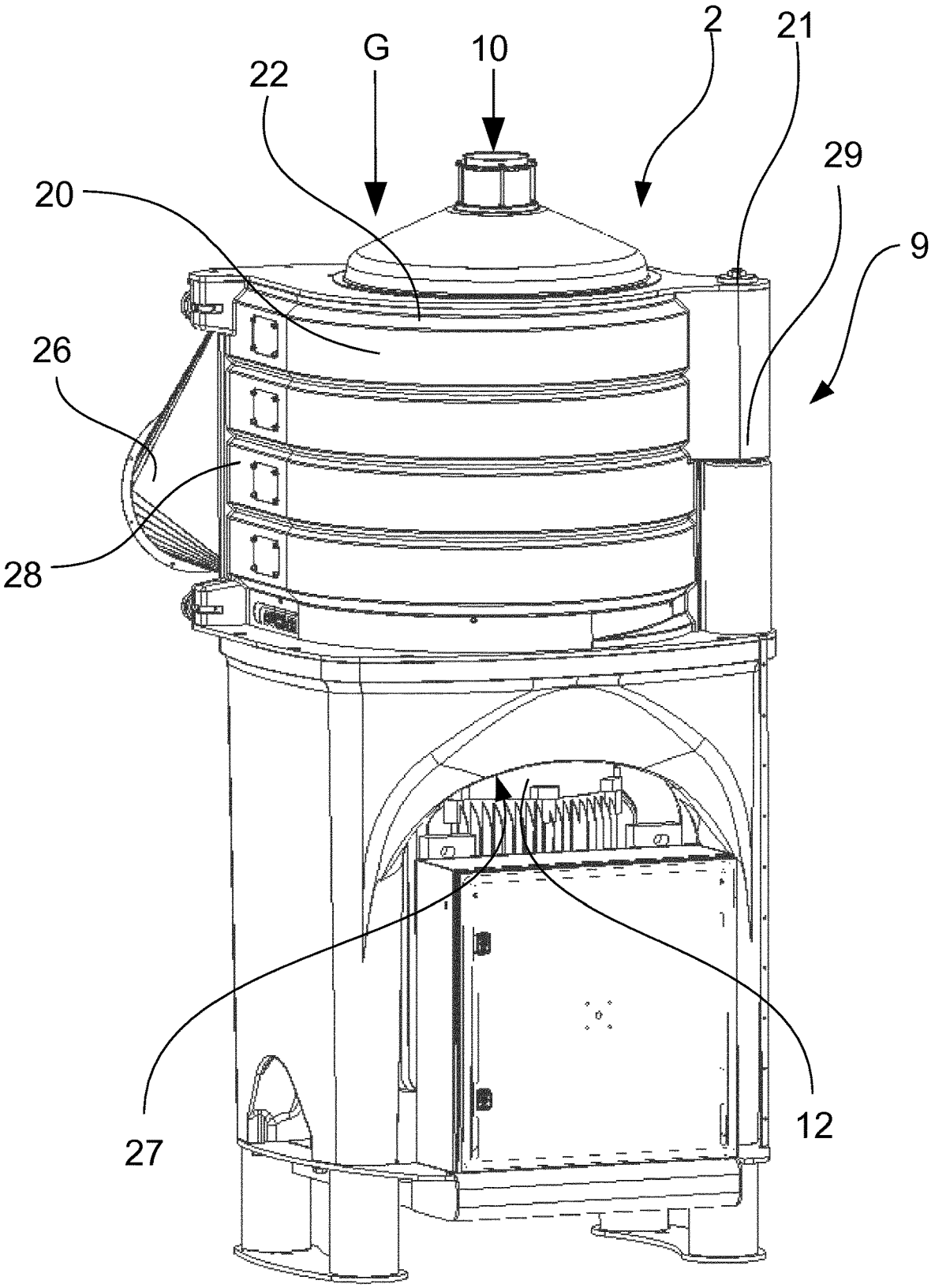
FIG. 3 shows the grinding machine of FIG. 2 in its entirety with closed chamber wall.
Figure 4:
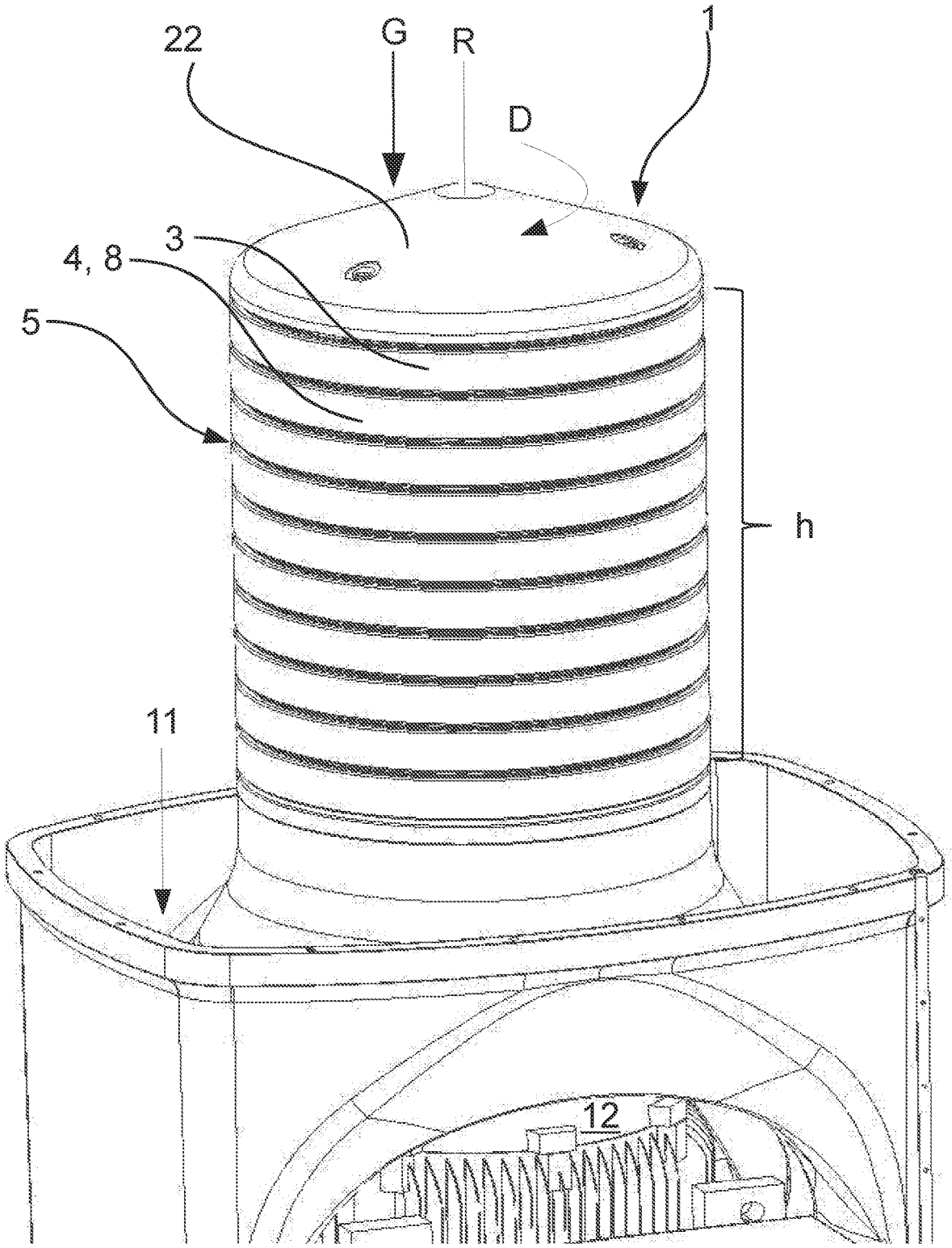
FIG. 4 shows the grinding machine of FIG. 3 without rotor housing.
Figure 5:
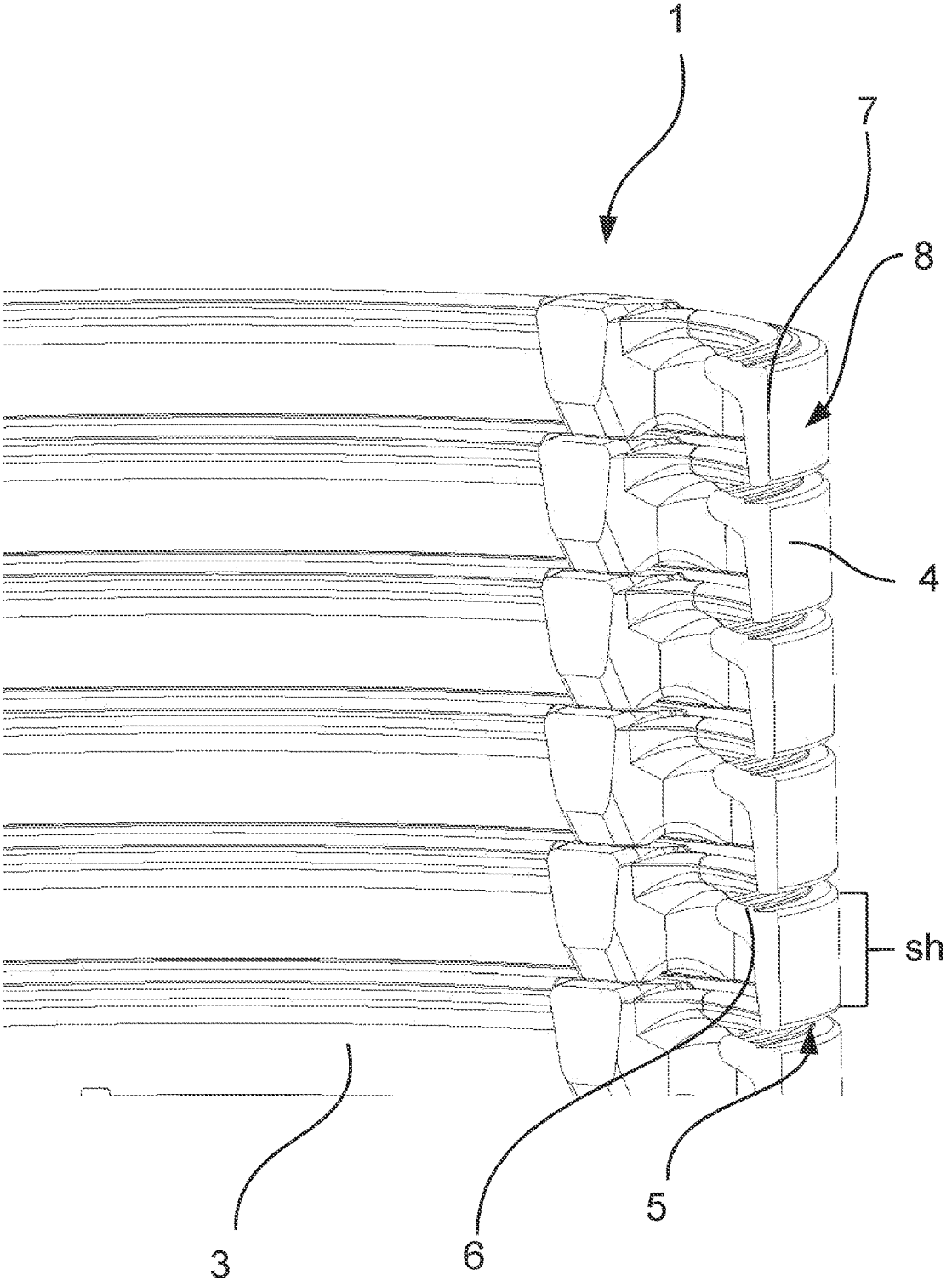
FIG. 5 shows a sectional view through stacked grinding elements.

The rotor 1 is surrounded by a chamber wall 15, which is better visible in FIG. 2, since one chamber half is opened about a hinge 21, as is the case for example when cleaning the grinding machine 2. The air passage openings formed as slots are shown in part in FIG. 2.

The rotor 1 at its upper end has a conical cover 22, which is used to distribute the product that is to be ground.

During operation the rotor 1 is driven in a direction of rotation D by an electric motor 12, which is arranged beneath the rotor 1. A drive shaft 13 of the electric motor 12 is connected to a rotor shaft 23 directly and coaxially with the rotor 1. The rotor 1 is mounted only in the region between electric motor 12 and rotor shaft 23. When feeding product through an inlet opening 10, the product can thus be directed towards the apex of the conical cover 22 and can thus be distributed over the entire circumference of the rotor 1.

The product falls as a result of the force of gravity through the grinding gap S formed between the grinding surface 4 and chamber wall 15, said grinding gap having a gap width of 20 mm. In so doing, the surface of the product is contacted and ground down by the grinding surface 4 of the quickly rotating rotor (1500-1800 revolutions/minute).

Figure 8:
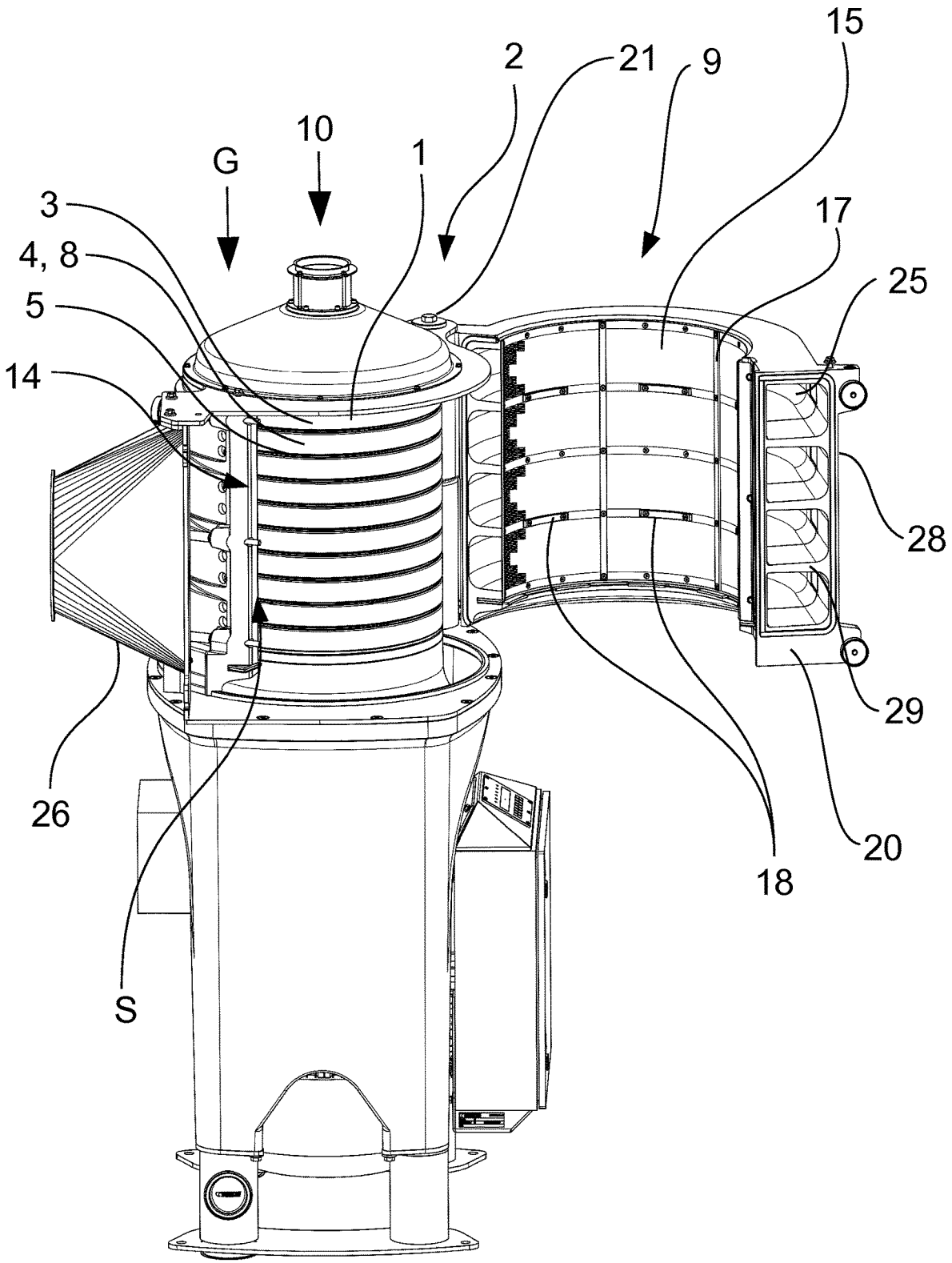
FIG. 8 shows a perspective view of a further embodiment of a grinding machine with opened chamber wall.

In order to prevent product particles from escaping the grinding surface 4 or in order to increase the residence time in the grinding gap, braking strips and backup strips 17 and 18 are arranged on the chamber wall 15 and deflect the product. The braking strips 17 extend in the axial direction of the rotor 1 and the chamber wall 15, which are arranged concentrically, whereas the backup strips 18, which are visible in FIG. 8, are formed as a circumferential segment and extend in the circumferential direction of the chamber wall 15. The radial distance between grinding surface 4 and braking strip 17 can be adjusted.

The product then leaves the grinding chamber 14 through an annular outlet 11. An annular orifice 19 is arranged at the outlet 1 and can be seen particularly clearly in FIG. 7 and is movable by means of an actuator 24. The annular orifice 19 can block the outlet 11, such that product is backed up in the grinding gap S. By adjusting an outlet cross-section, the annular orifice 19 can also define a throughput of the grinding machine 2.

The grinding dust produced during the grinding of the product and which consists of the abraded surface of the product is removed from the product flow via an air extraction device (not shown). In so doing, a negative pressure is generated in the grinding chamber 14 by means of the air extraction device. The chamber wall 15 is formed as a sieve surface and has a plurality of air passage openings 16, which are embodied as slots and which are dimensioned in such a way that they retain the product, but enable extraction of the grinding dust.

Air flows through inlet openings 27 in the motor region and in the region of the drive shaft 13 on account of the negative pressure prevailing in the grinding chamber 14 and is guided to the hollow interior of the rotor 1. The air gaps 5 of the rotor enable the air to flow through. Here, the created grinding dust is entrained by the airflow and is removed from the grinding gap S through the openings 16 of the chamber wall 15. In order to generate a uniform extraction power over the entire height h of the rotor 1, four ring channels 25 are arranged around the grinding chamber 14. Each ring channel is connected at one end to the intake port 26 of the air extraction device and runs around the grinding chamber 14. Radial bases 29 are formed between the ring channels 25 and extend between the chamber wall 15 and a lateral surface 28 of an air extraction casing 20. Since a wall of the ring channel 25 is formed by the chamber wall 15, the flow of air out from the grinding chamber 14 is thus possible. The other end of the ring channel 25 has small intake openings, which enable a small amount of air to be sucked in from the surrounding environment. Air, however, is sucked in primarily (more than 80% of the intake volume) through the inlet openings 27.

Figure 6:
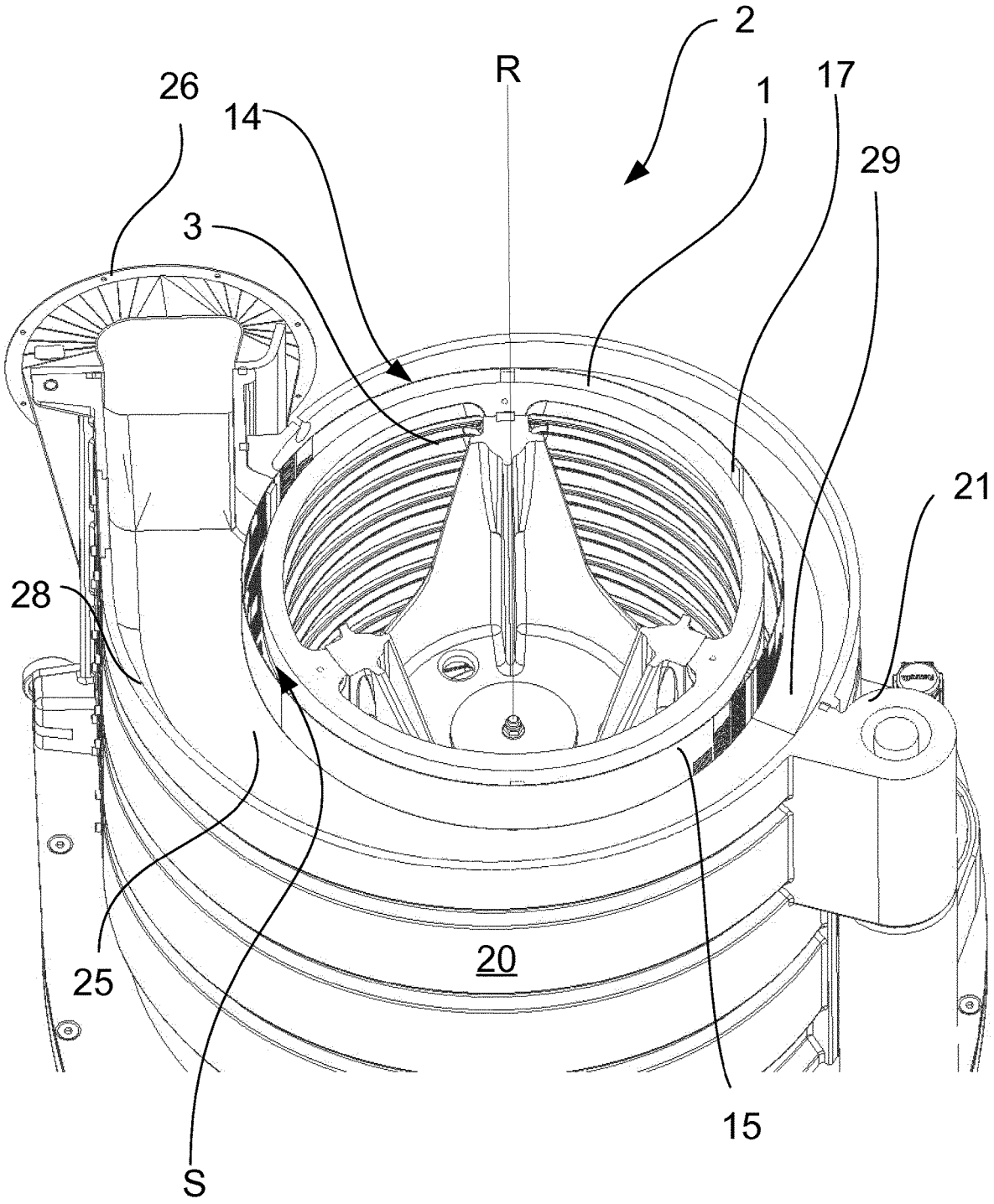
FIG. 6 shows a radial sectional view through the preferred embodiment of the grinding machine.
Figure 7:
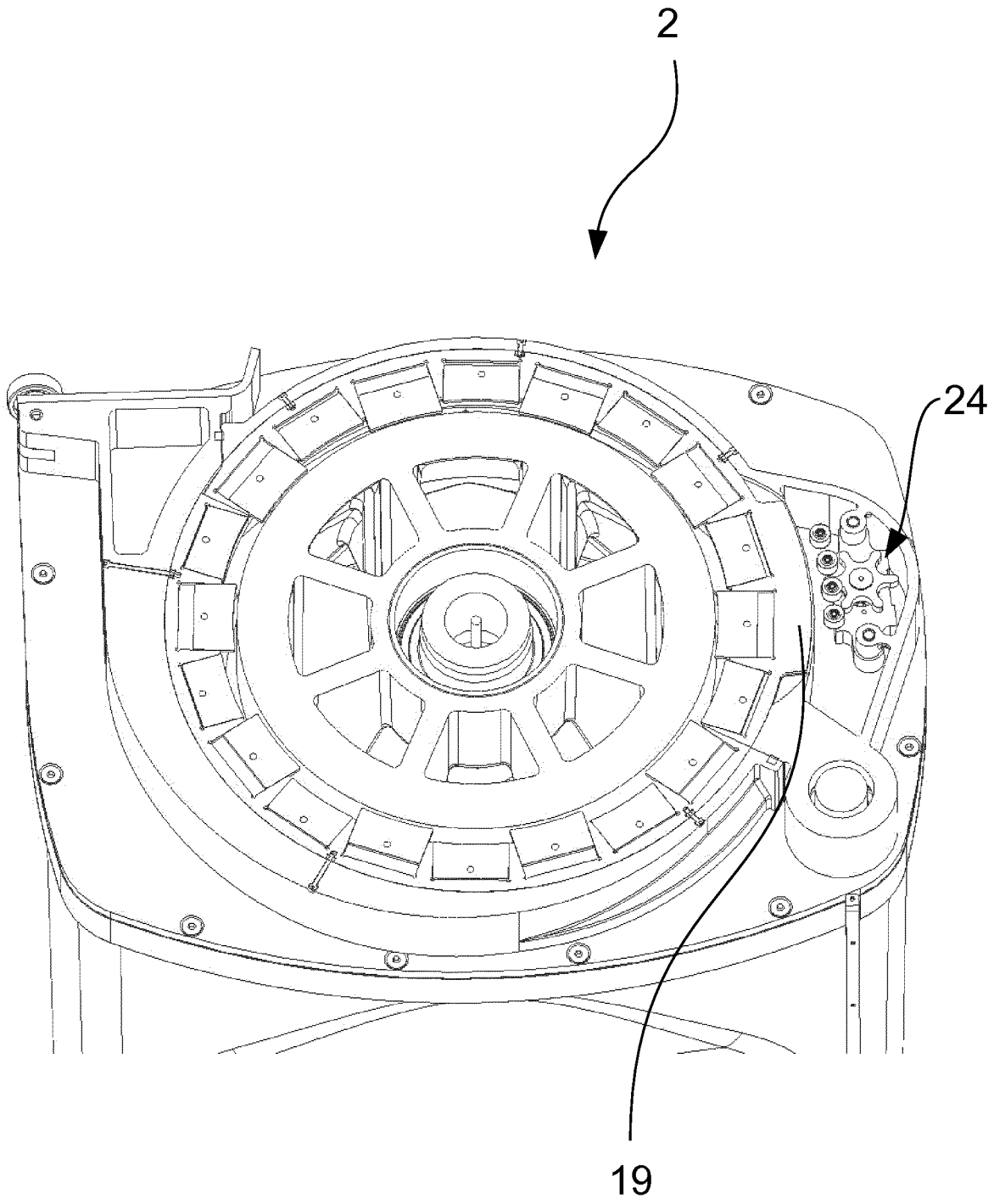
FIG. 7 shows a view of the preferred embodiment of the grinding machine without rotor, with visible annular orifice.

The lateral surface 28, as can be seen in FIG. 6, does not run concentrically with the rotor 1 or the chamber wall 15, but in a spiralled manner, starting from the small intake openings and in the circumferential direction (equal to the direction of rotation) of the rotor 1. A constant intake capacity is thus generated over the entire circumference of the rotor 1 and counteracts blockages and material accumulations.

The invention claimed is:

1. A rotor for a grinding machine for the foodstuffs and feedstock industry, comprising a plurality of substantially cylindrical grinding elements each having an outer grinding surface in the form of a circular cylinder jacket, wherein the grinding elements are arranged coaxially above one another and in such a way that a substantially annular air gap is produced between the grinding surfaces of two adjacent grinding elements, wherein a ratio between an enveloping surface of the rotor and a total grinding surface of the rotor is greater than 1.05 and less than 1.25, and the rotor has an outer diameter between 0.5 and 0.6 m.

2. The rotor according to claim 1, wherein the rotor has at least one of a total grinding surface between 0.7 and 1.2 $m^2$ or an enveloping surface between 0.8 and 1.5 $m^2$.

3. The rotor according to claim 1, wherein the rotor has a height between 0.5 and 0.6 m.

4. The rotor according to claim 1, wherein a ratio between the grinding element height and outer diameter is between 1/8 and 1/12.

5. The rotor according to claim 1, wherein the height of the annular air gap is between 5 and 9 mm.

6. The rotor according to claim 1, wherein one of said plurality of grinding elements comprises a main body having said outer grinding surface in the form of the circular cylinder jacket and also comprises a coating applied to the outer surface and the coating is a diamond coating.

7. A grinding machine for the foodstuffs and feedstock industry, comprising a rotor according to claim 1, a rotor housing with an inlet and an outlet for a product that is to be ground and for the product that has been ground, respectively, and a drive for driving the rotor (1), wherein the rotor is directly driven.

8. The grinding machine according to claim 7, wherein a grinding chamber with a chamber wall of the rotor housing is in the form of a circular cylinder jacket which coaxially surrounds the rotor, and a distance between the chamber wall and grinding surface is between 15 and 25 mm.

9. The grinding machine according to claim 8, wherein the chamber wall is provided with a plurality of air passage openings.

10. The grinding machine according to claim 8, wherein the chamber wall is provided with protruding braking strips and backup strips, which extend parallel with or in a manner running coaxially around the rotor axis, and the braking strips are adjustable, such that a protrusion relative to the chamber wall can be adjusted between 4 mm and 10 mm.

11. The grinding machine according to claim 7, further comprising an air extraction device.

12. An assembly comprising: an air extraction casing; the grinding machine for the foodstuffs and feedstock industry according to claim 7, and a rotor that can be driven and that is surrounded by a chamber wall provided with air passage openings, the air extraction casing comprising a lateral surface, which can be arranged around the chamber wall and can be fluidically connected to an air extraction device in order to generate a negative pressure, wherein a radial distance between the lateral surface and at least one of the chamber wall or the rotor axis increases at least in portions in a circumferential direction of the rotor.

13. The assembly according to claim 12, wherein the air extraction casing also comprises a plurality of radial bases, which extend between the chamber wall and the lateral surface.

14. The assembly according to claim 13, wherein the lateral surface extends in a spiralled manner.

15. The assembly according to claim 12, wherein the chamber wall is in the form of a circular cylinder jacket which coaxially surrounds the rotor, and a distance between the chamber wall and the grinding surface of the rotor is between 15 and 25 mm.

16. The assembly according to claim 12, wherein the chamber wall is provided with protruding braking strips and backup strips, which extend parallel with or in a manner running coaxially around the rotor axis, and the braking strips are adjustable, such that a protrusion relative to the chamber wall can be adjusted between 4 mm and 10 mm.

17. The assembly according to claim 12, further comprising an air extraction device.

* * * * *